299-13 SR
8/6/85 XR 4,533,181

United States Patent [19]
Ricketts

[11] Patent Number: 4,533,181
[45] Date of Patent: Aug. 6, 1985

[54] METHOD FOR FORMING UNIFORM FLOW RUBBLE BED

[75] Inventor: Thomas E. Ricketts, Grand Junction, Colo.

[73] Assignee: Occidental Oil Shale, Inc., Grand Junction, Colo.

[21] Appl. No.: 594,833

[22] Filed: Mar. 29, 1984

Related U.S. Application Data

[63] Continuation of Ser. No. 484,378, Apr. 12, 1983, abandoned.

[51] Int. Cl.[3] ..... E21C 41/10; E21B 43/247; E21B 43/263

[52] U.S. Cl. ..... 299/2; 166/259; 299/13

[58] Field of Search ..... 299/13, 11, 2; 166/259

[56] References Cited

U.S. PATENT DOCUMENTS

| | | | |
|---|---|---|---|
| 4,359,246 | 11/1982 | Ricketts | 299/13 X |
| 4,366,987 | 1/1983 | Ricketts et al. | 299/13 X |
| 4,372,615 | 2/1983 | Ricketts | 299/2 |
| 4,402,550 | 9/1983 | Ricketts | 299/13 X |
| 4,423,907 | 1/1984 | Ridley | 299/13 X |

OTHER PUBLICATIONS

*Handbook of Fluid Dynamics,* Victor L. Streeter, 1st Ed., McGraw-Hill (1961), pp. 17-33 and 17-34.

*Primary Examiner*—Stephen J. Novosad
*Assistant Examiner*—M. Goodwin
*Attorney, Agent, or Firm*—Christie, Parker & Hale

[57] ABSTRACT

An in situ oil shale retort containing a fragmented permeable mass of formation particles having a generally uniform permeability across horizontal cross-sections of the retort is provided. To form the retort, a void is excavated in a subterranean formation within the boundaries of the retort site, while at least one zone of unfragmented formation is left adjacent the void. A plurality of explosive charges are placed in the zone of unfragmented formation in a selected pattern; an array of central explosive charges and a plurality of perimeter charges arranged in rows surrounding the central charges. The spacing distance between each row of perimeter charges and an adjacent outer row of central charges is about equal. The combination of spacing distance and powder factor of the central charges is selected to produce a center portion of the fragmented permeable mass having a first average particle size ($d_1$) and a first average void fraction ($e_1$). The powder factor for each row of perimeter charges and the spacing distance between each outer row of central charges and an adjacent row of perimeter charges is selected to produce a perimeter portion of the fragmented permeable mass having a second particle size ($d_2$) and a second void fraction ($e_2$), the second average particle size ($d_2$) and the second average void fraction ($e_2$) being related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.1 to 6.0.

57 Claims, 9 Drawing Figures

METHOD FOR FORMING UNIFORM FLOW RUBBLE BED

This is a continuation of application Ser. No. 484,378, filed Apr. 12, 1983, now abandoned.

FIELD OF THE INVENTION

This invention relates to an in situ retort containing a fragmented permeable mass of formation particles in a retort site within a subterranean formation. More particularly, this invention relates to techniques for explosively expanding unfragmented formation toward a void for forming a fragmented permeable mass of formation particles having a desired configuration.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,597; 4,043,598; and 4,192,554; and in U.S. patent application Ser. No. 070,319, filed Aug. 27, 1979, by Chang Yul Cha and Thomas E. Ricketts, entitled TWO-LEVEL, HORIZONTAL FREE FACE MINING SYSTEM FOR IN SITU OIL SHALE RETORTS, now abandoned. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is also withdrawn from the bottom of the retort. Such off-gas can include carbon dioxide generated in the combustion zone, gaseous products produced in the retorting zone, carbon dioxide from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. A plurality of horizontally spaced apart vertical columnar explosive charges, i.e., an array of explosive charges, is placed in each of the unfragmented zones. The explosive charges are then detonated to explosively expand each unfragmented zone upwardly and/or downwardly toward the void or voids above and/or below it to form a fragmented mass having an average void volume about equal to the total volume of the voids. In effect, the volume of the excavated voids is distributed between the particles of the fragmented mass upon explosive expansion of the zones of unfragmented formation. The ratio of the volume of the void spaces between the particles to the total volume of the fragmented mass in the retort is the "void fraction" of the fragmented mass. The void fraction is generally given as a percentage and generally is between about 15% and 35%.

After the unfragmented formation is explosively expanded, retorting of the resulting fragmented mass is carried out to recover shale oil from the oil shale.

U.S. patent application Ser. No. 070,319 discloses a method for explosively expanding formation containing oil shale toward a horizontal free face to form a fragmented mass in an in situ oil shale retort. According to such a method, a void having a horizontal cross-section similar to the horizontal cross-section of the retort being formed is initially excavated. A plurality of vertically spaced zones of unfragmented formation are left above the void. Explosive is placed in each of the unfragmented zones and detonated for explosively expanding such zones toward the void to form a fragmented mass in the retort having an average void volume about equal to the void volume of the initial void. The overlying zones can be expanded toward the void in a single round or a plurality of rounds. Retorting of the fragmented mass is then carried out to recover shale oil from the oil shale.

It is desirable that a combustion zone passing downwardly through the fragmented permeable mass of formation particles in a vertical in situ oil shale retort be relatively flat. For example, when such a combustion zone is skewed (non-flat), shale oil and product gases produced in a lagging region of the combustion zone may be decomposed in a leading region of the combustion zone. Additionally, when the combustion zone is non-flat, the leading region of the combustion zone can reach the bottom of the retort before remaining regions. When any region of a combustion zone reaches the bottom of a retort, off-gas temperatures and/or the oxygen concentration in the off-gas can increase to above safe levels and it may be necessary to discontinue retorting. In this case, retorting is discontinued while oil shale particles in the fragmented mass downstream from lagging regions of the combustion zone remain unretorted.

It is, therefore, desirable to provide a method for explosively expanding oil shale formation toward a horizontal free face which results in the fragmented permeable mass of formation particles in the retort having a configuration which enhances the flatness of a combustion zone passing through it.

SUMMARY OF THE INVENTION

This invention relates to a method for recovering liquid and gaseous products from an in situ oil shale retort in a subterranean formation containing oil shale. The in situ retort contains a fragmented permeable mass of formation particles within top, bottom, and four generally vertically extending side boundaries of unfragmented formation. The fragmented permeable mass is made up of two portions; a center portion extending along the height of the retort and a perimeter portion surrounding the center portion and extending along the height of the retort between the center portion and the retort side boundaries. The center portion has a first average void fraction ($e_1$) and first average particle size ($d_1$). The perimeter portion has a second average void fraction ($e_2$) and second average particle size ($d_2$), at least one of which is different from the void fraction or particle size in the central portion.

An oxygen-supplying gas is introduced into the fragmented mass wherein the second average particle size ($d_2$) and the second average void fraction ($e_2$) are related to the first average particle size ($d_1$) and first average void fraction ($e_1$) so that the ratio of the superficial velocity ($V_2$) of such oxygen-supplying gas passing through the perimeter portion of the fragmented mass to the superficial velocity of such oxygen-supplying gas passing through the center portion of the fragmented mass is from about 0.1 to about 6.0.

In one embodiment of forming such an in situ retort, at least one void is excavated within the boundaries of the retort site in the subterranean formation, while at least one zone of unfragmented formation is left within the boundaries of the retort site having a generally horizontally extending free face adjacent the void. A plurality of horizontally spaced apart explosive charges are placed in the zone of unfragmented formation in a selected pattern. The selected charge pattern includes an array of central explosive charges spaced apart from the retort side boundaries where each of four outer rows of the array is parallel to an adjacent retort side boundary. A plurality of perimeter explosive charges surround the central charges. The perimeter charges are in four rows with each of the rows adjacent one of the side boundaries. The spacing distance between each such row of perimeter charges and the adjacent outer row of central charges is about equal to the spacing distance between each other such row of perimeter charges and its respective adjacent outer row of central charges. A combination of spacing distance and powder factor is selected for the central explosive charges for producing the center portion of the fragmented permeable mass. Additionally, the powder factor of the perimeter charges and the spacing distance between each outer row of central charges and the adjacent row of perimeter charges is selected for producing the perimeter portion of the fragmented permeable mass. The central and outer explosive charges are detonated in a single round time delay sequence for explosively expanding the zone of unfragmented formation toward the void to form the fragmented mass of formation particles in the retort.

DRAWINGS

These and other features, aspects, and advantages of the present invention will be more fully understood when considered with respect to the following detailed description, appended claims, and accompanying drawings wherein:

Figure 8:
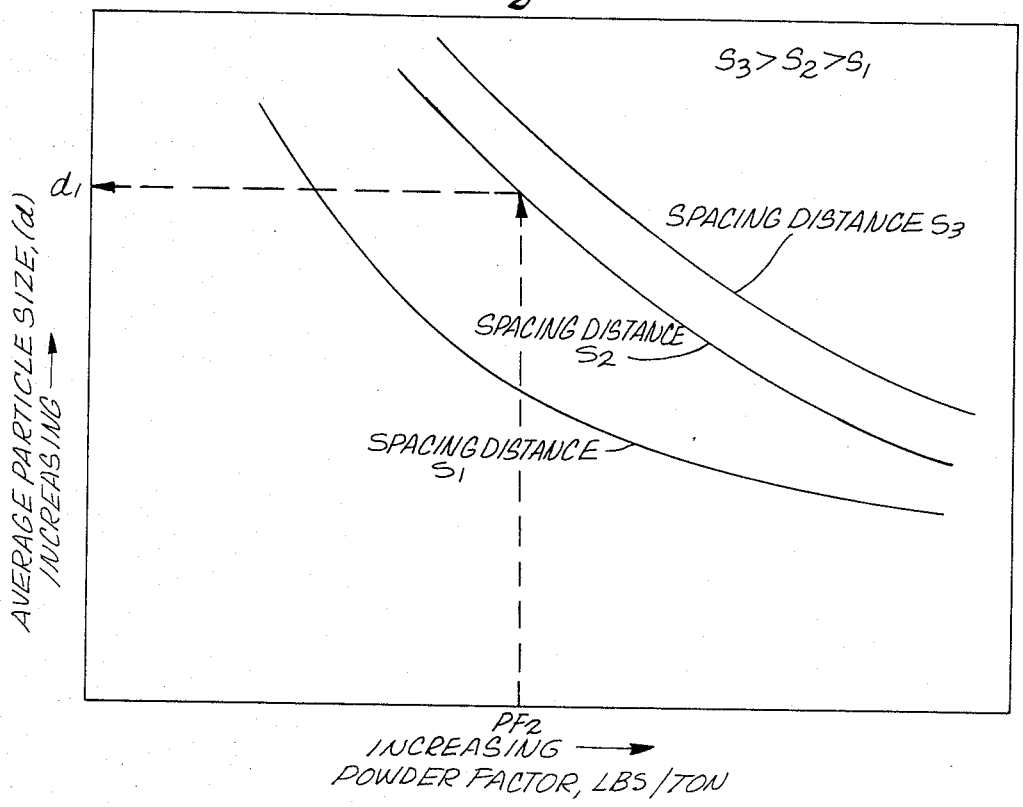
Figure 9:
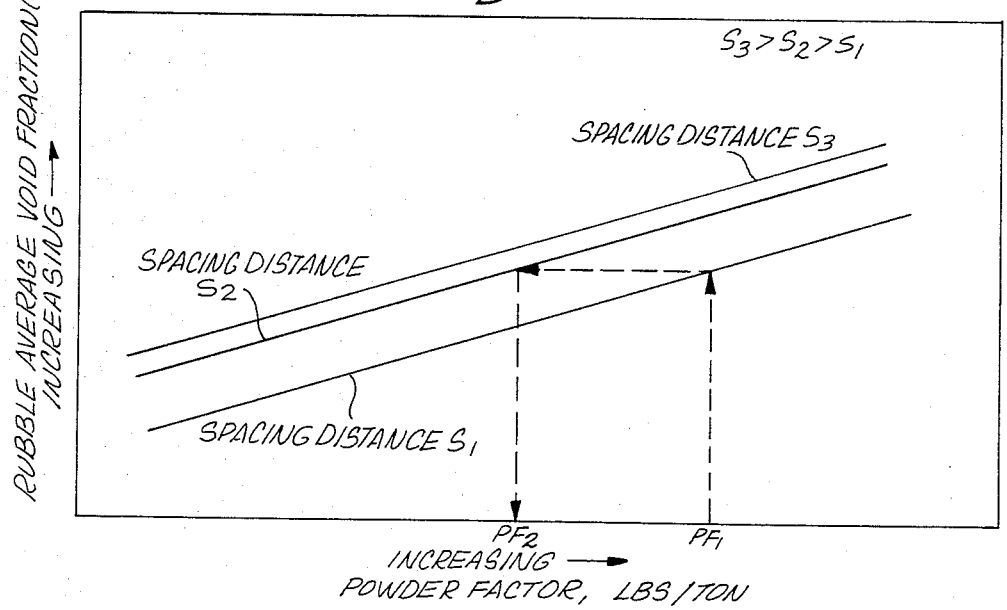

FIG. 8 is a graph showing a relationship between the average particle size of a fragmented mass and the powder factor of the explosive charges used for forming the fragmented mass for charges that have a spacing distance of $S_1$, $S_2$, and $S_3$, respectively; and FIG. 9 is a graph showing a relationship between the average void fraction of a fragmented mass and the powder factor of explosive charges used for forming the fragmented mass for charges that have a spacing distance of $S_1$, $S_2$, and $S_3$, respectively.

DETAILED DESCRIPTION

Figure 1:
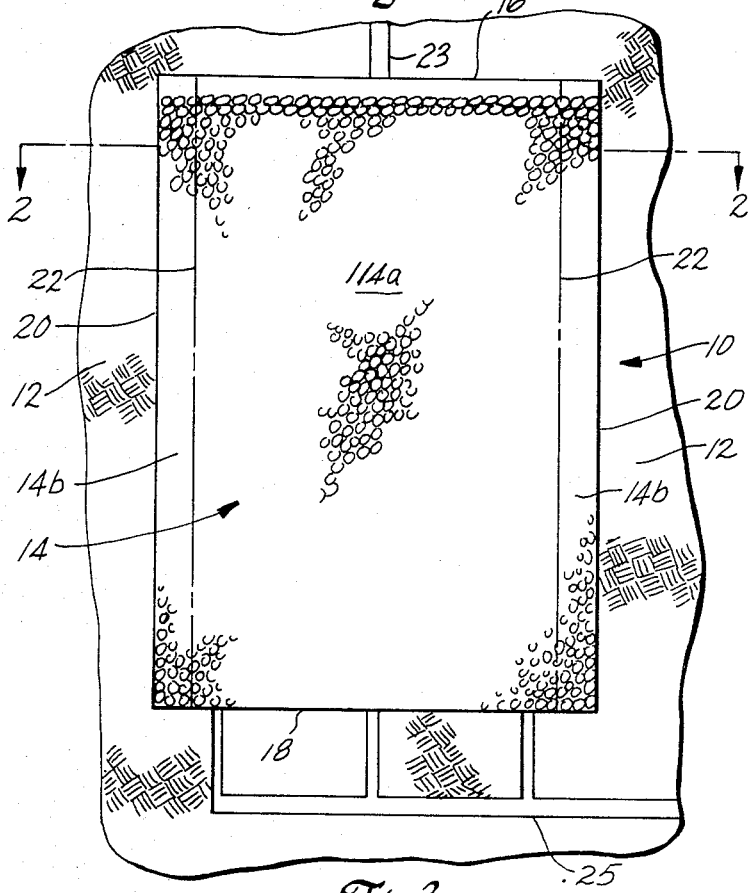
FIG. 1 is a semi-schematic, vertical, cross-sectional view of one embodiment of an in situ oil shale retort formed in a subterranean formation in accordance with practice of principles of this invention.
Figure 2:
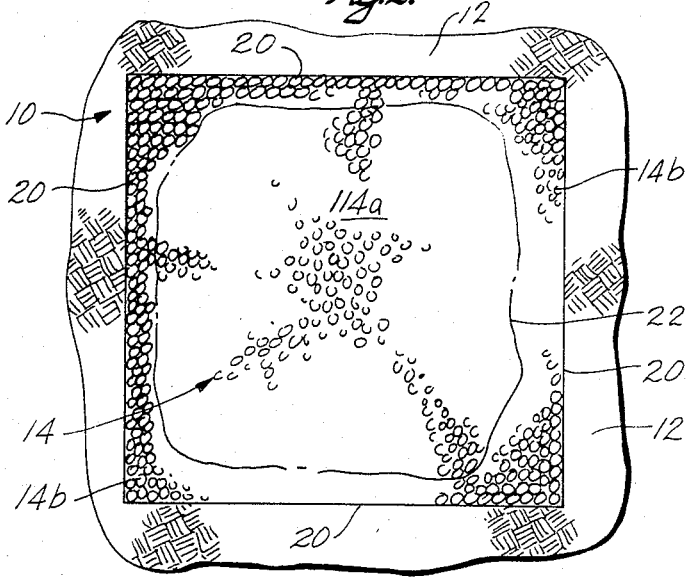
FIG. 2 is a semi-schematic, horizontal, cross-sectional view taken on line 2—2 of FIG. 1.

Referring to FIGS. 1 and 2, there are shown semi-schematic, vertical and horizontal cross-sections, respectively, of one embodiment of an in situ oil shale retort 10 formed in accordance with practice of principles of this invention in a subterranean formation 12 containing oil shale. The retort 10 contains a fragmented permeable mass of formation particles 14 within top 16, bottom 18, and four generally vertically extending side boundaries 20 of unfragmented formation. Although the illustrated retort 10 is generally square in horizontal cross-section, retorts having rectangular cross-sections other than square, and also retorts with non-rectangular cross-sections, are contemplated.

As is described below in greater detail, a horizontal free face blasting technique, provided in accordance with practice of this invention, results in the fragmented permeable mass 14 having two portions or regions; a first portion 14*a* that occupies a center region of the retort and extends vertically in a column from the retort bottom boundary 18 along the height of the retort and a second portion 14*b* that extends from the retort bottom boundary along the height of the retort between the center portion 14*a* and the retort side boundaries 20. Thus, the outer portion 14*b* of the fragmented mass occupies the perimeter region of the retort and surrounds the fragmented mass central portion 14*a* along its height.

The center and perimeter portions 14*a* and 14*b*, respectively, of the fragmented mass are different from each other in that their average void fractions and/or the average size of particles constituting the two portions are different. Although the portions 14*a* and 14*b* are shown in FIGS. 1 and 2 as being divided sharply from each other by the dashed lines 22, the portions may actually blend somewhat into each other.

During retorting operations, a combustion zone is established in the fragmented mass of formation particles 14 and is advanced downwardly through the fragmented mass by introduction of oxygen-supplying gas into the retort through one or more inlets 23 at the top of the retort. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off-gas containing gaseous products pass to the bottom of the fragmented mass and are withdrawn from the product withdrawal drift 25. A pump (not shown) is used to withdraw liquid products from a sump (not shown) to above ground. Off-gas is withdrawn by a blower (not shown) and passed to above ground.

Preferably, the mass flow rate of oxygen-supplying gas flowing through the center portion 14*a* of the fragmented mass per unit cross-sectional area of the center portion is about equal to the mass flow rate of oxygen-supplying gas flowing through the perimeter portion 14*b* of the fragmented mass per unit cross-sectional area of the perimeter portion.

When the mass flow rate of oxygen-supplying gas per unit area is equal in each horizontally spaced portion of a fragmented permeable mass in a retort, equal oxygen flux is provided to all horizontally spaced regions of the combustion zone advancing through the retort. This results in the combustion zone being generally flat and progressing generally uniformly through the retort.

The mass flow rate of gas per unit area for any portion or region of a fragmented mass in a retort is the total gas flow rate into that portion, e.g., standard cubic feet per minute (SCFM), divided by the horizontal cross-sectional area of that portion. The units of mass flow rate per unit area are SCFM/ft$^2$ or ft/min which is the superficial velocity (V) of the gas. Thus, in accordance with this invention, it is desired that the superficial flow velocity ($V_1$) of gas passing through the center portion 14*a* of the fragmented mass be about equal to the superficial velocity ($V_2$) of gas passing through the perimeter portion 14*b*. It is considered that the superficial velocity $V_1$ of gas passing through the center portion is about equal to the superficial velocity $V_2$ of gas passing through the perimeter portion if the ratio of $V_2/V_1$ is from about 0.5 to 1.5.

Although the ratio of superficial gas flow velocity ($V_2$) through the perimeter portion 14*b* of the fragmented mass to the superficial gas flow velocity ($V_1$) through the center portion 14*a* is preferably from about 0.5 to 1.5, a ratio $V_2/V_1$ of from about 0.1 to about 6.0 provides a combustion zone of acceptable flatness.

The superficial flow velocities of gas passing through different horizontally spaced portions of a fragmented mass can be related by the equation $$\frac{V_2}{V_1} = \left(\frac{d_2}{d_1}\right)^2 \times \left(\frac{1-e_1}{1-e_2}\right)^2 \times \left(\frac{e_2}{e_1}\right)^3. \quad (1)$$

where $V_1$=superficial flow velocity of gas passing through a first portion of a fragmented mass in a retort;

$V_2$=superficial flow velocity of gas passing through a second portion of the fragmented mass;

$d_1$ and $d_2$=average size of formation particles constituting the first and second portions, respectively, of the fragmented mass; and $e_1$ and $e_2$=void fractions of the first and second portions, respectively, of the fragmented mass.

Equation (1) is based on Ergun's equation which describes gas flow in a fixed packed bed as:

$$\frac{\Delta P}{L} g_c = C_1 \frac{(1-e)^2}{e^3} \frac{V}{(\phi d)^2} \quad (2)$$

where $\Delta P/L$ is the pressure drop per length of the bed, e is the average void fraction, V is the superficial velocity of gas passing through the bed, d is the average particle size, $\phi$ is a particle shape factor or sphericity factor for non-spherical particles, $C_1$ is a constant, and $g_c$ is a dimensional constant.

Equation (2) is valid for gas flow exhibiting low Reynolds numbers, e.g., Reynolds numbers less than about 20 (the laminar flow region where viscous losses predominate). Thus, equation (1) is useful for retorts where gas flow is in the laminar flow region.

At high Reynolds numbers, e.g., Reynolds numbers greater than about 1,000, i.e., the turbulent flow region, only kinetic energy losses need be considered and Ergun's equation appears as:

$$\frac{\Delta P}{L} g_c = C_2 \frac{1-e}{e^3} \frac{V^2}{\phi d}. \quad (3)$$

In the intermediate gas flow region, i.e., for Reynolds numbers of from about 20 to 1,000, Ergun's equation becomes:

$$\frac{\Delta P}{L} g_c = C_1 \frac{(1-e)^2}{e^3} \frac{V}{(\phi d)^2} + C_2 \frac{1-e}{e^3} \frac{V^2}{\phi d}. \quad (4)$$

For retorts where gas flow has a Reynolds number from about 20 to 1,000, values for the ratio $V_2/V_1$ can be derived from equation (4).

The retort-forming method provided in accordance with practice of this invention is useful for forming the retort 10 containing a fragmented mass 14 where the average particle size and void fraction of the center and perimeter portions 14*a* and 14*b*, respectively, of the fragmented mass are related in such a way that the ratio of $V_2$(superficial velocity of gas through the perimeter portion) to $V_1$ (superficial velocity of gas through the center portion) is from about 0.1 to about 6.0, and preferably from about 0.5 to about 1.5. This is the case whether gas flow through the fragmented mass exhibits a Reynolds number of less than about 20 and equation (1) is used or whether gas flow through the fragmented mass is between about 20 and 1,000 where both the laminar and turbulent flow portions of Ergun's equation must be considered.

Although it is preferable that the fragmented mass contained in the retort 14 have only two portions, retorts having a fragmented mass with three or more portions with each such portion extending from the top surface of the fragmented mass to the retort bottom boundary are contemplated. In accordance with practice of this invention, the ratio of the superficial gas flow velocity through any one of the portions of the fragmented mass to the superficial gas flow velocity through any other such portion is preferably from about 0.1 to about 6.0 and, more preferably, is about equal, i.e., from about 0.5to 1.5.

In the past, attempts have been made to form retorts containing a fragmented permeable mass of formation particles having uniform rubble properties, i.e., a fragmented mass with equal particle size and void fraction in horizontal regions across the retort, so that the mass flow rate of gas through the retort would be uniform. These attempts have been only partially successful.

Figure 3:
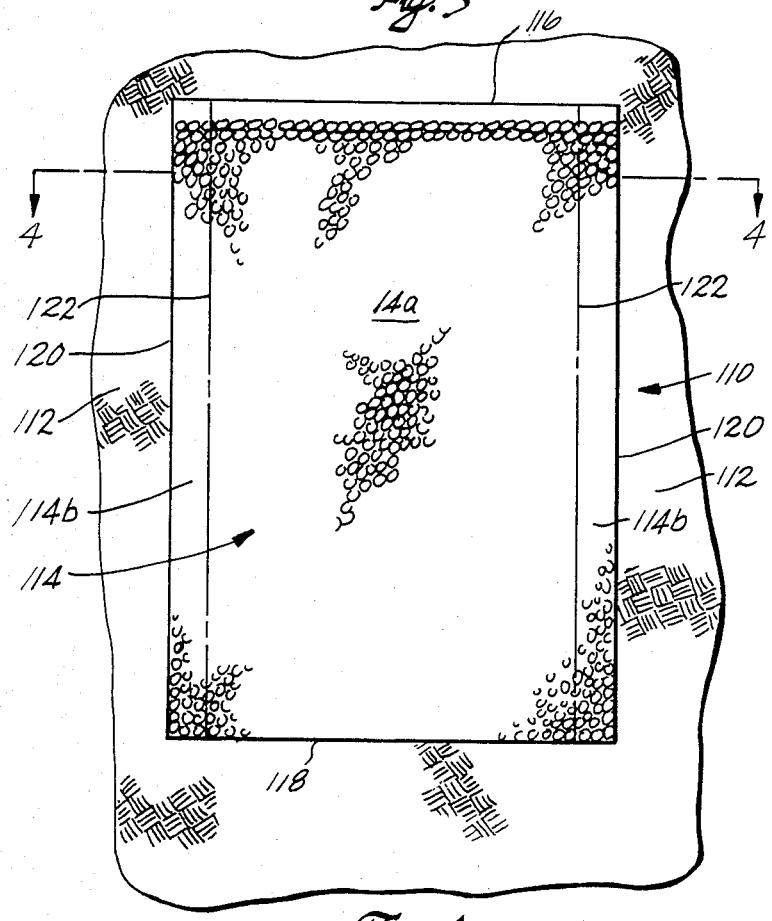
FIG. 3 is a semi-schematic, vertical, cross-sectional view of an in situ oil shale retort formed in the Piceance Creek Basin of Colorado.
Figure 4:
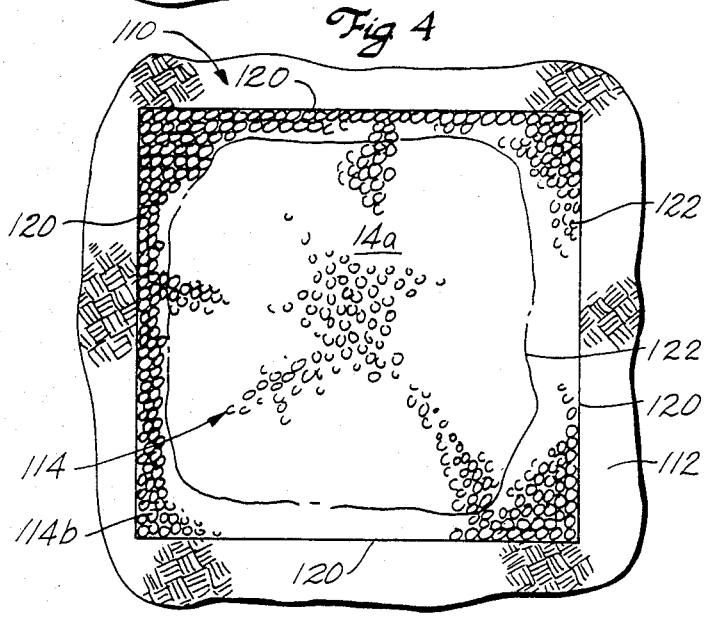
FIG. 4 is a semi-schematic, horizontal, cross-sectional view taken on line 4—4 of FIG. 3.

For example, two in situ oil shale retorts having a shape similar to the shape of the retort 10 were formed in oil shale formation on the rim of the Piceance Creek Basin in Colorado. Turning to FIGS. 3 and 4, there are shown semi-schematic, vertical and horizontal cross-sectional views of one of the retorts 110 formed in the oil shale-containing subterranean formation 112 on the rim of the Piceance Creek Basin. Both of the formed retorts are described with reference to the retort 110 since they are essentially identical and were formed using the same procedure.

The retort 110 was square in horizontal cross-section and contained a fragmented permeable mass of formation particles 114 within top, bottom, and side boundaries 116, 118, and 120, respectively, of unfragmented formation. Each of the side boundaries was about 165 feet in length and the retort was about 242 feet tall.

The fragmented mass 114 had two regions or portions shown divided by the dashed lines 122, a center portion 114*a*, and an outer portion 114*b*. The center and outer portions 114*a* and 114*b*, respectively, were positioned in the retort 110 in the same relationship to each other as the portions 14*a* and 14*b* of the fragmented mass of the retort 10 shown in FIGS. 1 and 2.

Each of the portions of the fragmented mass 114 had a relatively uniformly distributed void fraction and particle size distribution. The center portion 114*a* was generally cylindrical in shape with a diameter varying between about 135 and 145 feet. The outer or perimeter portion 114*b* was in a band about 10 to 15 feet wide surrounding the center portion. The average particle size in both portions was about the same, while the average void fraction in the center portion 114*a* was less than the average void fraction of the perimeter portion.

When equation (1) set forth above was used to calculate the ratio of the superficial gas flow velocity ($V_2$) through the perimeter portion 114*b* to the superficial gas flow velocity ($V_1$) through the center portion 114*a*, it was found that the value of $V_2/V_1$ was outside the desired range of 0.1 to 6.0 and was about 9.

Since the same method was used to form both retorts (both the retort 110 and its companion retort) and the retorts were essentially identical, the method used to form them can be repeated time after time with predictable results. Thus, to form the retort 10 containing the fragmented mass 14 with the portions 14*a* and 14*b* having a combination of properties of average particle size and void fraction which results in a desired ratio of superficial gas flow velocities through the portions, in accordance with this invention, modifications are made to the method used for forming the retort 110. For purposes of exposition herein, the procedure used for forming the retort 110 is called the "reference retort-forming procedure" and the retort 110 is called the "reference retort".

REFERENCE RETORT-FORMING PROCEDURE

Figure 5:
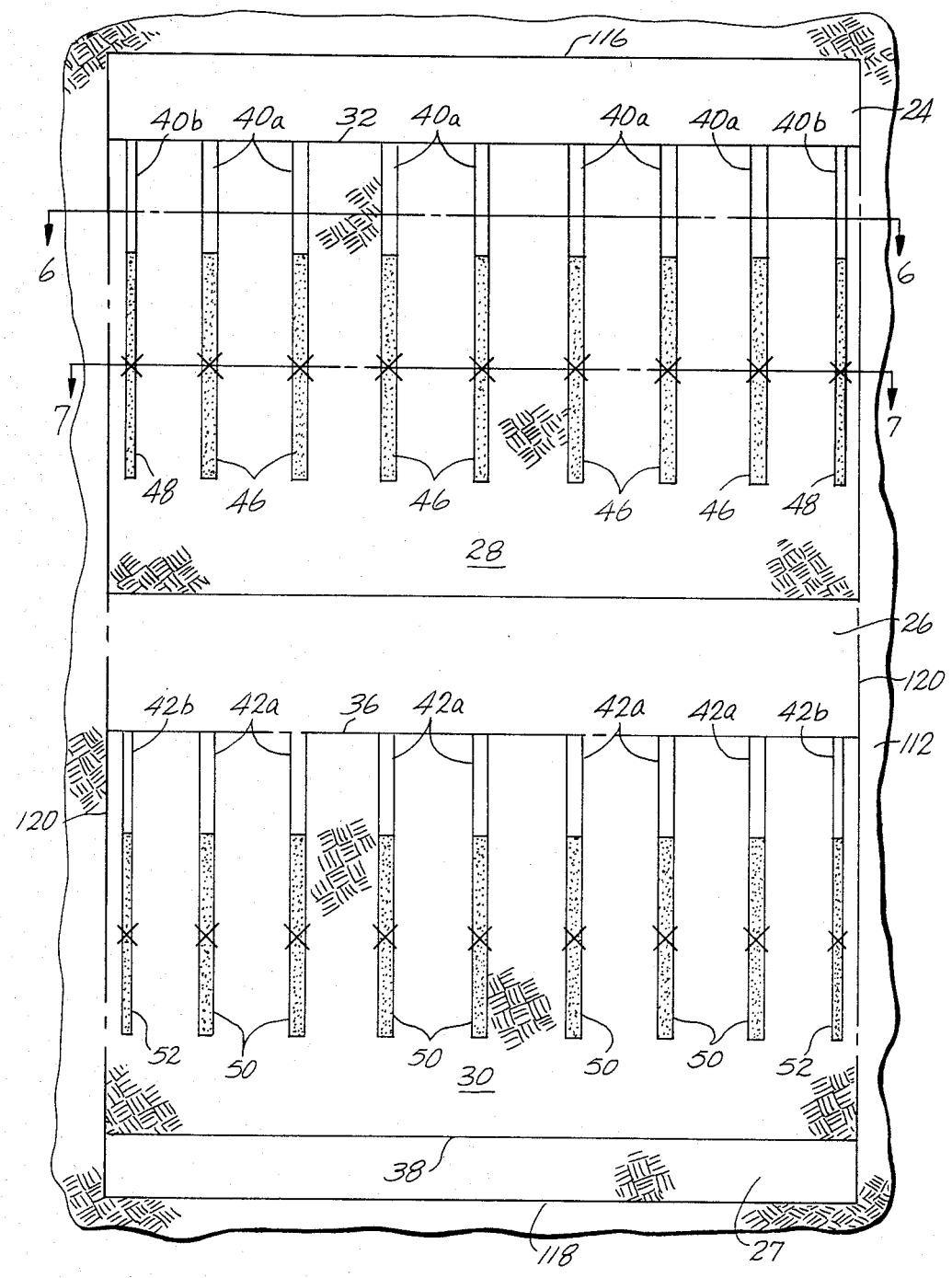
FIG. 5 is a semi-schematic, vertical, cross-sectional view of the retort shown in FIG. 3 at one stage during its formation.
Figure 6:
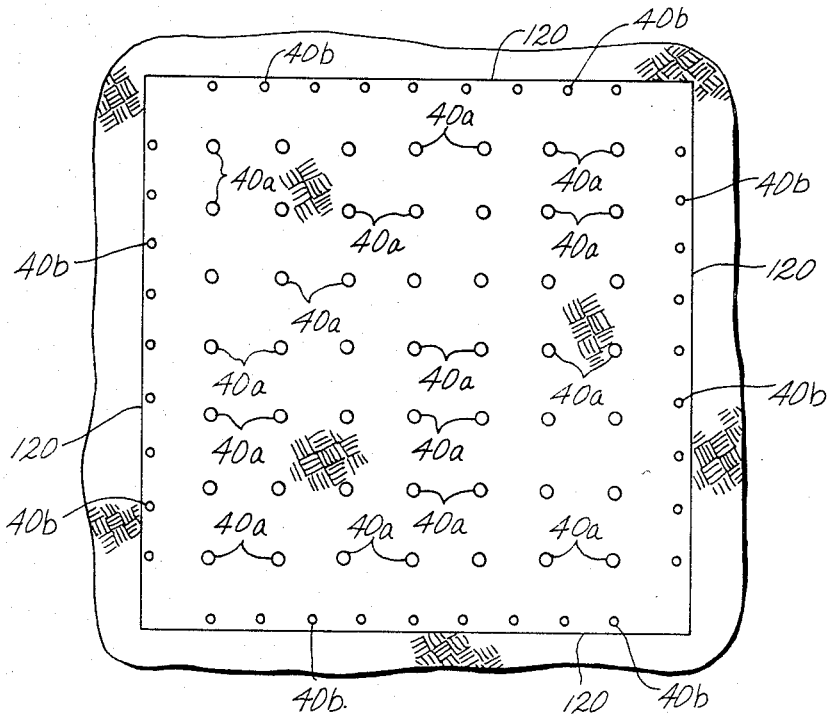
FIG. 6 is a semi-schematic, horizontal, cross-sectional view taken on line 6—6 of FIG. 5.

The method that was used to form the retort 110 (reference retort) can be understood by referring to FIGS. 5 and 6, which are semi-schematic, vertical and horizontal cross-sectional views, respectively, of the retort 110 at one stage during its formation in the subterranean formation 112.

Referring particularly to FIG. 5, a generally horizontally extending upper level void 24, a generally horizontally extending intermediate level void 26, and a generally horizontally extending lower level void 27 were excavated within the top, bottom, and side boundaries 116, 118, and 120, respectively, of the retort. The upper void 24 was about 18 feet in height, the intermediate void 26 was about 29 feet in height, and the lower void 27 was about 13 feet in height. An upper zone of unfragmented formation 28, about 96 feet thick, was left extending between the upper and intermediate voids, while a lower zone of unfragmented formation 30, about 85 feet thick, was left extending between the intermediate and lower level voids. The upper zone of unfragmented formation included a generally horizontally extending upper free face 32 defining the floor of the upper void and a generally horizontally extending lower free face 34 defining the roof of the intermediate void. The lower zone of unfragmented formation included a generally horizontally extending upper free face 36 defining the floor of the intermediate void and a generally horizontally extending lower free face 38 defining the roof of the lower void.

Each of the voids 24, 26, and 27 is a "limited void" with respect to the volume of formation to be explosively expanded toward that void; that is, each such void has less available volume than would be required for free expansion of formation toward the void.

When an earth formation is explosively fragmented and expanded, it increases in bulk due to the void space in interstices between the particles. The maximum expansion of an oil shale formation into an unlimited void results in a fragmented mass having an average void fraction of about 40%; that is, about 40% of the total volume occupied by the fragmented mass is void space between the particles.

A "limited void" is one where the void space available for explosive expansion is less than needed for free bulking of the formation expanded toward that void. Thus, if a void has an excavated volume less than about 40% of the total of the volume of the void plus the volume occupied by formation explosively expanded, it is necessarily a limited void. It has been found that factors in addition to total available void can make a void "limited" even though the total available void may appear sufficient for free bulking.

Additional information regarding limited voids can be found in U.S. Pat. No. 4,336,966 which is incorporated herein by this reference.

A plurality of horizontally spaced apart blastholes 40 and 42 were drilled into the upper and lower zones of unfragmented formation, respectively. The blastholes 40 were drilled into the upper zone from the void space 24 and the blastholes 42 were drilled into the lower zone from the void space 26. If desired, the blastholes can be drilled upwardly from the adjacent voids below. Each of the blastholes 40 and 42 extended through about three-quarters of the thickness of the zone of unfragmented formation into which they were drilled and were about perpendicular to the horizontal free faces.

The pattern of the array of blastholes 40 in the upper zone of unfragmented formation was identical to the pattern of the array of blastholes 42 in the lower zone. Thus, for simplicity of explanation, only the pattern of the array of blastholes 40 in the upper zone is described below in detail. If desired, the pattern of the array of blastholes in the upper zone can be different from the pattern of the array of blastholes in the lower zone.

As is best seen in FIG. 6, the array of blastholes 40 in the upper zone included a plurality of central blastholes 40*a* spaced apart from the retort side boundaries and a plurality of outer or perimeter blastholes 40*b* adjacent the retort side boundaries and surrounding the central blastholes. The central blastholes 40*a* were in a square array or pattern with the spacing between adjacent central blastholes about equal in orthogonal directions.

The perimeter blastholes 40*b* were smaller in diameter than the central blastholes and were in four rows with each such row adjacent one of the retort side boundaries. The spacing distance between the perimeter blastholes was less than the spacing distance between the central blastholes and the spacing between each row of perimeter blastholes and the adjacent outer row of central blastholes was the same as the spacing distance between central blastholes.

A square array of central blastholes 42*a* was formed in the lower zone identical to the square array of central blastholes 40*a* in the upper zone. Additionally, a band of perimeter blastholes 42*b* was formed in the lower zone identical to the band of perimeter blastholes 40*b* in the upper zone.

After the blastholes were formed, they were loaded with an explosive to form the explosive charges used for expanding the formation toward the voids. A columnar explosive charge 46 was formed in each of the central blastholes 40*a* to thereby form a square array of horizontally spaced apart central explosive charges. The charges 46 extended from the center of elevation of the upper zone 28 about half the distance toward each of the free faces 32 and 34.

A columnar explosive charge 48 was formed in each of the perimeter blastholes 40*b* to thereby form a band of horizontally spaced apart perimeter charges 48 surrounding the central charges. The charges 48 extended from the center of elevation of the upper zone 28 about half the distance toward each of the free faces 32 and 34.

A columnar explosive charge 50 was formed in each of the central blastholes 42*a* in about the middle half of the lower zone of unfragmented formation to thereby form a square array of horizontally spaced apart central explosive charges 50. A columnar explosive charge 52 was formed in each of the perimeter blastholes 42*b* in about the middle half of the lower zone to thereby form an array of horizontally spaced apart perimeter charges 52. Each of the charges 50 and 52 extended from about the center of height of the zone 30 of unfragmented formation about half the distance toward each of the free faces 36 and 38.

The powder factor of the perimeter explosive charges 48 and 52 was equal to the powder factor of the central explosive charges 46 and 50. Thus, the powder factor was uniform for both the upper and lower zones of unfragmented formation. The term "powder factor" as used herein is the ratio of the amount of energy or explosive used per unit volume of formation explosively expanded and its value is in pounds of ANFO equivalent per ton of oil shale formation expanded.

To provide a powder factor in a row of perimeter charges equal to the powder factor of a row of central charges, only about half the amount of explosive is needed in the perimeter row. This is because the perimeter row expands only about one-half the amount of formation that is expanded by a row of central charges, thus each perimeter charge was made smaller than each central charge. So that the smaller perimeter charges would interact properly, they were spaced closer together.

Additional details of providing perimeter or outer explosive charges with a powder factor equal to central charges are set forth in U.S. patent application Ser. No. 208,862 filed Nov. 21, 1980, by Robert J. Fernandes and Thomas E. Ricketts, and titled METHOD FOR FORMING AN IN SITU OIL SHALE RETORT WITH HORIZONTAL FREE FACES, now U.S. Pat. No. 4,366,987. U.S. patent application Ser. No. 208,862 is incorporated herein by this reference.

Detonators designated by an "x" were placed in each explosive charge 46, 48, 50, and 52 at about the center of each charge column and each of the blastholes was stemmed with inert material (not shown) above the charge.

All of the explosive charges were detonated in a single round time delay sequence for explosively expanding the zones of unfragmented formation, both upwardly and downwardly toward the voids to form the fragmented mass of formation particles 114 in the retort. A "single round" as used herein means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

Although not shown or described, temporary roof support pillars of unfragmented formation were left in the voids extending between adjacent zones of unfragmented formation. The pillars were explosively expanded in the instants preceding the explosive expansion of the upper and lower zones. Details of explosively expanding such pillars can be found in my U.S. Pat. No. 4,300,800 which is incorporated herein by this reference.

Figure 7:
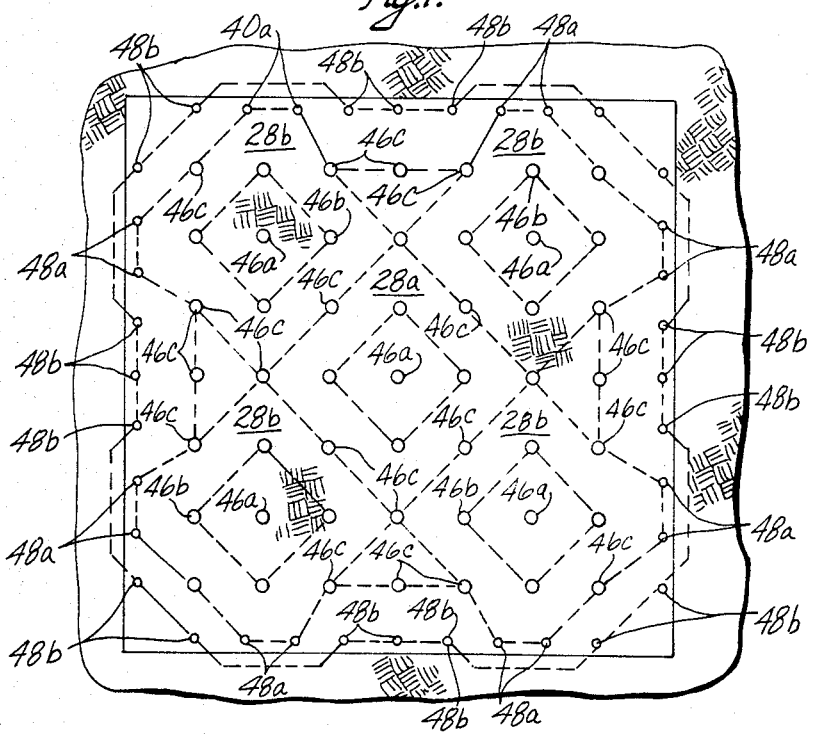
FIG. 7 is a semi-schematic, horizontal, cross-sectional view taken on line 7—7 of FIG. 5.

The detonation sequence of explosive charges in the upper and lower zones 28 and 30, respectively, can best be understood by referring to FIG. 7, which is a horizontal cross-sectional view taken on line 7—7 of FIG. 5. Both the upper and lower zones 28 and 30, respectively, of unfragmented formation were explosively expanded in the same single round, with detonations of the explosive charges in the time delay sequence described in detail below. The charges detonated at the same time are shown connected by dashed lines.

To form the fragmented mass in the retort 110, the upper zone 28 was explosively expanded in five contiguous regions; a center region 28*a* at about the center of the zone and four outer regions 28*b* surrounding the center region, with each outer region adjacent the center region. Each such region extended from the lower free face 34 vertically to the upper free face 32.

The lower zone 30 was explosively expanded in five regions that were identical in horizontal cross-section to the five regions of the upper zone, with each region of the lower zone located directly below its respective region in the upper zone. In both the upper and lower zones, the same time delay pattern of detonations was used and each region of the upper zone was expanded at the same time as its companion region in the lower zone. For example, each of the five regions in both the upper and lower zones was expanded in sequential portions with the portion of each region of the upper zone expanded at the same time as a corresponding portion of each such region of the lower zone.

A first portion of the center region 28*a* and a first portion of each of the four outer regions 28*b* were expanded about simultaneously toward the voids by first initiating detonation of the explosive charges 46*a* in the center of each such region. Preferably, the charges 46*a* are in a quincunx. In this instance, the first portion of each region was at about the center of the region and extended from the free face 32 to the free face 34. The free face at each end of the first portion of each such region was, therefore, at about the center of the area of the free face of its respective region.

After a time delay of about one millisecond per foot of spacing distance between central blastholes, the central explosive charges 46*b* were detonated simultaneously for expanding a second portion of each of the five regions toward the voids. The charges 46*b* were in a band radially spaced from and surrounding the charges 46*a*. Thus, the upper and lower horizontally extending free face of each second portion of each region was adjacent to and surrounded the respective free face of each first portion.

After an additional time delay of about one millisecond per foot of spacing distance between central blastholes, the explosive charges 46*c* (the remainder of the central charges) and the perimeter charges 48*a* were detonated for explosively expanding a third portion of each such region toward the voids. The horizontally extending upper and lower free faces of each such third portion were adjacent to and surrounded the free face of each second portion. After an additional short time delay, the charges 48*b* (the remaining undetonated perimeter charges) were detonated for explosively expanding the remaining portion of each such region toward the voids.

As was mentioned above, the lower zone 30 of unfragmented formation was explosively expanded at the same time as the upper zone using the same time delay pattern.

Additional details of explosively expanding zones of unfragmented formation in adjoining regions can be found in U.S. patent application Ser. No. 277,852 filed by me on June 26, 1981, titled FORMATION OF AN IN SITU OIL SHALE RETORT WITH CONTROL OF MOUNDING, now U.S. Pat. No. 4,423,908 U.S. patent application Ser. No. 277,852 is incorporated herein by this reference.

Referring again to FIGS. 3 and 4, as is mentioned above, the outer portion 114*b* of the fragmented permeable mass 114 in the retort 110 formed by the above described "reference retort-forming procedure" had an average void fraction that was higher than the average void fraction of the center portion 114*a*, while the average particle size in both portions was about equal. Thus, the superficial velocity ($V_2$) of gas flowing through the outer portion 114*b* is higher than the superficial velocity ($V_1$) of gas flowing through the central portion. Furthermore, the ratio $V_2/V_1$ was found to be about 9.

The void fraction in the center portion 114*a* of the fragmented mass 114 was different from the void fraction in the perimeter portion 114*b* due mainly to the effects of the side walls of the voids on the explosive expansion of the zones of unfragmented formation.

Retort Forming Procedure in Accordance With Practice of This Invention

The spacing distance between explosive charges in a zone of unfragmented formation, e.g., the spacing distance between the central explosive charges, the spacing distance between the perimeter charges, and the spacing between an outer row of central charges and the adjacent row of perimeter charges affects the average void fraction and particle size in the region of the fragmented mass formed by detonation of those charges. In addition, the powder factor of the explosive charges affects the average void fraction and particle size of the fragmented mass formed by their detonation.

General relationships of charge spacing and powder factor to the average particle size and void fraction of a fragmented mass produced by detonation of arrays of charges were developed for oil shale and are shown in FIGS. 8 and 9. The spacing distance on both figures relates either to spacing between adjacent central charges or to spacing between an outer row of central charges and an adjacent row of perimeter charges.

Referring particularly to FIG. 8, the relationship of average particle size to powder factor is shown separately for explosive charges that have a spacing distance of $S_1$, $S_2$, and $S_3$, where ($S_3 > S_2 > S_1$). From FIG. 8, it can be seen that as spacing between charges increases at a given powder factor, the average size of particles produced by detonation of the charges increases. Further, when the spacing between charges is held constant and the powder factor of the charges is decreased, the size of the particles formed by detonation of the charges is increased, while increasing the powder factor decreases particle size.

Referring to FIG. 9, the relationship of the magnitude of the average void fraction of a fragmented mass of particles formed by detonation of explosive charges to the powder factor of the charges is shown separately for charges that have a spacing distance of $S_1$, $S_2$, and $S_3$. From FIG. 9, it can be seen that as spacing distance between charges increases at a given powder factor, the rubble void fraction of the fragmented mass formed by detonation of those charges increases. Further, when the spacing between charges is held constant, increasing the powder factor of the charges increases the void fraction, while decreasing the powder factor reduces the void fraction.

Relationships such as those shown in FIGS. 8 and 9 can be developed for oil shale by performing blasting tests and then measuring the particle size and void fractions of the rubble mass produced.

In accordance with this invention, the configuration of the fragmented mass 114 formed in the retort 110 is used as a basis for applying powder factor and spacing relationships shown in FIGS. 8 and 9. These relationships are preferably applied to modify the spacing and/or powder factor of the central charges 46 and 50 used in the "reference retort-forming procedure" to thereby form the retort 10 provided in accordance with this invention.

For example, the spacing distance and powder factor of the central charges is selected for producing the center portion 14*a* of the fragmented mass 14 having a first average particle size ($d_1$) and a first average void fraction ($e_1$), while the powder factor and the spacing distance between each outer row of central charges and the adjacent row of perimeter charges is selected for producing the perimeter portion 14*b* of the fragmented mass 14 having a second average particle size ($d_2$) and a second void fraction ($e_2$).

As a result of the selection of powder factor and spacings for the central and perimeter charges in accordance with this invention, the second average particle size ($d_2$) and the second average void fraction ($e_2$) are related to the first average particle size ($d_1$) and the first average void fraction ($e_1$) so that the ratio of superficial gas flow velocity ($V_2$) through the perimeter portion 14*b* of the fragmented mass to the gas flow velocity ($V_1$) through the center portion 14*a* of the fragmented mass is in the range of from about 0.1 to 6.0 and preferably in the range of 0.5 to 1.5 based on equation (1) set forth above.

In one exemplary embodiment of practice of this invention, it is desired that the fragmented mass 14 have a center portion 14*a* with the same average void fraction that was provided in the center portion 114*a* of the fragmented mass 114 and a perimeter portion 14*b* with the same average void fraction that was provided in the perimeter portion 114*b*.

So that the ratio of $V_2/V_1$ falls within the desired range (0.1 to 6.0), the average particle size of the center portion 14*a* of the fragmented mass can be increased sufficiently from the average particle size of the center portion 114*a* of the reference retort 110 by changing the spacing and/or the powder factor of the central charges 46 and 50.

In this embodiment, the perimeter charges 48 and 52 have the same arrangement (spacing and powder factor) as those used to form the reference retort 110. Since the configuration of the perimeter portion of a fragmented mass is determined primarily by the pattern of the perimeter explosive charges, their powder factor, and the spacing between the outer row of central charges and the adjacent row of perimeter charges, the perimeter portion 14*b* of the fragmented permeable mass 14 will have the same characteristics of average void fraction and particle size as the perimeter portion 114*b* of the fragmented mass 114.

For purposes of exposition herein, the center portion 14*a* of the fragmented mass 14 has an average void fraction $e_1$ that is the same as the average void fraction of the center portion 114*a* and the perimeter portion 14*b* has an average void fraction $e_2$ and an average particle size $d_2$ that are the same as the average void fraction and particle size of the perimeter portion 114*b*.

When the average void fraction in both the center and perimeter portions 14*a* and 14*b*, respectively, are known and the average particle size $d_2$ of the perimeter portion is known, equation (1) can be used to find the average particle size $d_1$ of the center portion that will give the desired ratio of $d_1/d_2$ so that $V_2/V_1$ falls within the desired range of 0.1 to 6.0.

To determine a combination of spacing and powder factor for the central charges required to obtain a desired average particle size $d_1$ of the center portion 14*a*, the relationships of FIGS. 8 and 9 are used. Since there are two variables (powder factor and spacing) and only one equation, the process takes the form of an iteration.

To explain the process used in accordance with this invention, the spacing distance between central charges used for forming the fragmented mass 114 in the retort 110 is, for example, $S_1$ and the powder factor is $PF_1$. As a first step in the process of selecting center charge spacing to increase the average particle size in the center portion 14*a* so that the ratio of $d_1/d_2$ and hence the ratio of $V_2/V_1$ falls within the desired range of 0.1 to 6.0, a spacing for the central charges is selected that is larger than the spacing $S_1$. In this exemplary embodiment, the spacing $S_2$ is selected.

Since the average void fraction of the center portion 14*a* is to be the same as the average void fraction of the center portion 114*a* and the central charges 46 and 50 used to form the portion 114*a* had a powder factor of $PF_1$, it is determined from FIG. 9 that the average void fraction of the center portion will remain unchanged when central charges spaced at $S_2$ have a powder factor of $PF_2$. Turning to FIG. 8, it is determined that a powder factor of $PF_2$ for central charges will result in an average particle size of the center portion 14*a* being $d_1$.

Thus, knowing the average particle size $d_2$ and void fraction $e_2$ of the perimeter portion and the average particle size $d_1$ and void fraction $e_1$ of the center portion, equation (1) can be used to calculate the ratio of $V_2/V_1$. If the ratio is within the desired range and is satisfactory, $S_2$ is selected as the spacing distance of the central charges. If the ratio is not satisfactory, then a new value S for spacing of central charges can be selected and the iteration process repeated. Although FIGS. 8 and 9 show relationships for spacings $S_1$, $S_2$, and $S_3$, any number of such relationships can be readily provided.

In one exemplary embodiment of practice of this invention, the retort 10 is formed by the reference retort-forming procedure with the outer charges 48 and 52 having a powder factor of 1.9 pounds/ton and a spacing distance of 15 feet; the spacing between each outer row of central charges and the adjacent row of perimeter charges is 20 feet; and the spacing distance between central charges 46 and 50 is 25 feet with the powder factor of the central charges being 1.5 pounds/ton. In this embodiment, the ratio of $V_2/V_1$ is predicted to be about 2.2.

To accommodate the increased charge spacing between the rows of central charges, the retort side boundaries could be increased in length or, alternatively, if desired, the side boundaries can be left unchanged and the number of central charges can be decreased.

In accordance with this invention, retorts having various cross-sections and dimensions other than those of the retort 110 can be provided. Also, in accordance with this invention, it can be understood that there are any number of combinations of spacing and powder factor for central charges that will provide a central region of the fragmented mass having the desired characteristics of average void fraction and particle size to provide a ratio of $V_2/V_1$ in the desired range.

In another embodiment, the retort 10 is formed using the reference retort-forming procedure with the perimeter charges 48 and 52 having a powder factor of 1.9 pounds/ton and a spacing distance of 15 feet; the spacing between each outer row of central charges and the adjacent row of perimeter charges is 20 feet and the spacing distance between central charges 46 and 50 is 30 feet with the powder factor of the central charges being 1.35 pounds/ton. In this embodiment, the ratio of $V_2/V_1$ is predicted to be about 1.3.

In an exemplary embodiment such as the embodiments described above where the fragmented mass 14 has two portions, i.e., a center portion 14*a* and perimeter portion 14*b*, with the average void fraction of the perimeter portion being higher than the average void fraction of the center portion, a ratio of $V_2/V_1$ between 0.5 and 1.0 may be preferred. This is due to the fact that the center portion 14*a* has a lower void fraction (higher rubble density) and a larger particle size than does the perimeter portion 14*b*. Thus, the center portion 14*a* of the fragmented mass requires a relatively higher mass flow rate of oxygen-supplying gas to provide a combustion rate that is equal to the combustion rate in the perimeter portion 14*b*.

Therefore, in the exemplary embodiments described above, it may be desired to increase the particle size of the center portion further by using a spacing distance between central charges of greater than 30 feet so that the ratio of $V_2/V_1$ is between about 0.5 and 1.0.

As was the case with the previous embodiment, to accommodate the increased spacing of central charges, the retort side boundaries can be increased in length or, alternatively, if desired, the number of central charges can be decreased.

In yet another exemplary embodiment provided in accordance with practice of this invention, both the spacing distance and powder factor of the central charges can be increased compared to the spacing distance and powder factor of the central charges used for forming the reference retort 110.

In an exemplary embodiment where both the spacing distance and powder factor of the central charges is increased, the retort 10 is formed using the reference retort-forming procedure with the perimeter charges 48 and 52 having a powder factor of 1.9 pounds/ton and a spacing distance of 15 feet; the spacing distance between each outer row of central charges and the adjacent row of perimeter charges being about 20 feet and the spacing distance between the central charges 46 and 50 is 30 feet with the powder factor of the central charges being about 2.2 pounds/ton. In this embodiment, the ratio of $V_2/V_1$ is predicted to be about 1.6.

After the desired spacing and powder factor for the central and perimeter charges are determined in accordance with this invention and the arrays of charges are in place in the upper and lower zones of unfragmented formation, they are detonated to form the fragmented permeable mass 14 in the retort 10. Preferably, the charges are detonated in the same sequence that was used in the reference retortforming procedure. Since, however, it is primarily the spacing and powder factor of the explosive charges that determines the average void fraction and particle size of the various regions of the fragmented mass, detonation sequences other than the sequence used for forming the reference retort can be used in accordance with this invention, if desired. For example, each zone of unfragmented formation can be explosively expanded in four regions instead of five. Alternatively, the explosive charges near the horizontal center of the retort can be detonated first, followed by sequential detonations of explosive charges in bands moving radially from the center.

In other embodiments of practice of this invention, more than two voids can be excavated and each zone of unfragmented formation between adjacent voids can be expanded to form the retort 10. Alternatively, a retort can be formed in accordance with this invention by excavating a single void within the retort boundaries, while leaving a single zone of unfragmented formation within the retort boundaries adjacent the void. The zone of unfragmented formation can be explosively expanded in sequential, vertically spaced layers, starting with a layer nearest the void until the layer adjacent the retort top boundary is expanded. Center and outer charges provided for explosively expanding each layer can be adjusted as appropriate in accordance with this invention to form the retort 10.

Additional details of forming a retort by explosively expanding formation in layers toward a single void can be found in U.S. Pat. No. 4,349,227 and in U. S. patent application Ser. No. 246,232 titled TWO-LEVEL, HORIZONTAL FREE FACE MINING SYSTEM FOR IN SITU OIL SHALE RETORTS, filed by Chang Yul Cha and me on Mar. 23, 1981, now abandoned. Application Ser. No. 246,232 and U.S. Pat. No. 4,349,227 are incorporated herein by this reference.

After the fragmented permeable mass 14 of oil shale particles is formed in the retort 10, retorting operations can be commenced.

The above description of exemplary methods for forming an in situ oil shale retort 10 in a subterranean formation containing oil shale, including the description of patterns of explosive charges and detonation sequences used to expand zones of unfragmented formation, is for illustrative purposes. Because of variations which will be apparent to those skilled in the art, the present invention is not intended to be limited to the particular embodiments described above. The scope of the invention is defined in the following claims.

What is claimed is:

1. A method for recovering liquid and gaseous products from an in situ oil shale retort in a retort site in a subterranean formation containing oil shale, the in situ retort containing a fragmented permeable mass of formation particles within top, bottom, and four generally vertically extending side boundaries of unfragmented formation, the method comprising the steps of:

excavating at least one void in the subterranean formation within the boundaries of the retort site, while leaving at least one zone of unfragmented formation within the boundaries of the retort site having a generally horizontally extending free face adjacent the void;

placing a plurality of horizontally spaced apart explosive charges in a selected pattern in such a zone of unfragmented formation, the selected pattern comprising:

an array of central explosive charges spaced apart from the side boundaries of the retort site, each of four outer rows of the array being about parallel to an adjacent retort side boundary; and a plurality of perimeter explosive charges surrounding the central charges, the perimeter charges being in four rows with each of the rows adjacent one of the side boundaries, the spacing distance between each such row of perimeter charges and the adjacent outer row of central charges being about equal to the spacing distance between each other such row of perimeter charges and its respective adjacent outer row of central charges;

selecting a combination of spacing distance and powder factor for the central explosive charges for producing a center portion of the fragmented permeable mass having a first average particle size ($d_1$) and a first average void fraction ($e_1$);

selecting a powder factor for each row of perimeter charges and a spacing distance between each outer row of central charges and the adjacent row of perimeter charges for producing a perimeter portion of the fragmented permeable mass having a second average particle size ($d_2$) different from the first average particle size ($d_1$) and a second average void fraction ($e_2$) different from the first average void fraction ($e_1$);

detonating the central and perimeter explosive charges for explosively expanding the zone of unfragmented formation toward the void to form the fragmented permeable mass of formation particles in the retort;

introducing an oxygen-supplying gas into the fragmented permeable mass, the second average particle size ($d_2$) and the second average void fraction ($e_2$) being related to the first average particle size ($d_1$) and the first average void fraction ($e_1$) so that the ratio of the superficial velocity ($V_2$) of such oxygen-supplying gas passing through the perimeter portion of the fragmented mass to the superficial velocity ($V_1$) of such oxygen-supplying gas passing through the center portion of the fragmented mass is from about 0.1 to about 6.0.

2. The method according to claim 1 wherein the powder factor of the central explosive charges is less than the powder factor of the perimeter explosive charges.

3. The method according to claim 1 wherein the powder factor of the central explosive charges is greater than the powder factor of the perimeter explosive charges.

4. The method according to claim 1 wherein the spacing distance of the central explosive charges is greater than the spacing distance between each such outer row of central charges and the adjacent row of perimeter charges.

5. The method according to claim 1 wherein the second average particle size ($d_2$) and the second average void fraction ($e_2$) are related to the first average particle size ($d_1$) and the first average void fraction ($e_1$) so that the ratio of $V_2/V_1$ is from about 0.5 to 1.5.

6. The method according to claim 1 wherein the powder factor of the central charges is about 1.5 pounds/ton and the spacing distance of the central charges is about 25 feet, and the powder factor of the outer perimeter charges is about 1.9 pounds/ton and the spacing distance between each outer row of central charges and the adjacent row of perimeter charges is about 20 feet.

7. The method according to claim 1 wherein the powder factor of the central charges is about 1.35 pounds/ton and the spacing distance of the central charges is about 30 feet, and the powder factor of the perimeter charges is about 1.9 pounds/ton and the spacing distance between each outer row of central charges and adjacent row of perimeter charges is about 20 feet.

8. The method according to claim 1 comprising explosively expanding such a zone of unfragmented formation toward such a void by approximately simultaneously explosively expanding sequential portions of five horizontally spaced adjoining regions of the zone, a center region at about the center of the zone, and four outer regions collectively surrounding the center region, each of the five regions extending vertically from the generally horizontally extending free face adjacent the void, the five regions explosively expanded in sequential portions by the steps of:

detonating central explosive charges for explosively expanding a first portion of each such region toward the void, wherein the horizontally extending free face of each such first portion is near the center of such a region; thereafter detonating central explosive charges for explosively expanding a second portion of each such region toward the void, wherein the horizontally extending free face of each such second portion is adjacent the respective free face of each such first portion and surrounds the free face of each such first portion; thereafter detonating the remainder of the central explosive charges and a plurality of the perimeter explosive charges for explosively expanding a third portion of each such region toward the void, wherein the horizontally extending free face of each such third portion is adjacent the free face of each such second portion and surrounds the free face of each such second portion; and thereafter detonating the remainder of the perimeter explosive charges for explosively expanding the remaining portion of each such region toward the void.

9. The method according to claim 8 wherein the powder factor of the central charges is about 1.5 pounds/ton and the spacing distance of the central charges is about 25 feet, and the powder factor of the outer perimeter charges is about 1.9 pounds/ton and the spacing distance between each outer row of central charges and the adjacent row of perimeter charges is about 20 feet.

10. The method according to claim 8 wherein the powder factor of the central charges is about 1.35 pounds/ton and the spacing distance of the central charges is about 30 feet, and the powder factor of the perimeter charges is about 1.9 pounds/ton and the spacing distance between each outer row of central charges and adjacent row of perimeter charges is about 20 feet.

11. The method according to claim 1 wherein the second average particle size ($d_2$) and the second average void fraction ($e_2$) are related to the first average particle size ($d_1$) and the first average void fraction ($e_1$) so that the ratio of $V_2/V_1$ is from about 0.5 to 1.0.

12. A method for forming an in situ oil shale retort in a retort site in a subterranean formation containing oil shale, the in situ retort containing a fragmented permeable mass of formation particles within top, bottom, and four generally vertically extending side boundaries of unfragmented formation, the method comprising the steps of:

excavating at least one void in the subterranean formation within the boundaries of the retort site, while leaving at least one zone of unfragmented formation within the boundaries of the retort site having a generally horizontally extending free face adjacent the void;

placing a plurality of horizontally spaced apart explosive charges in a selected pattern in such a zone of unfragmented formation, the selected pattern comprising:

an array of central explosive charges spaced apart from the side boundaries of the retort site, each of four outer rows of the array being about parallel to an adjacent retort side boundary; and a plurality of perimeter explosive charges surrounding the central charges, the perimeter charges being in four rows with each of the rows adjacent one of the side boundaries, the spacing distance between each such row of perimeter charges and the adjacent outer row of central charges being about equal to the spacing distance between each other such row of perimeter charges and its respective adjacent outer row of central charges;

selecting a combination of spacing distance and powder factor for the central explosive charges for producing a center portion of the fragmented permeable mass having a first average particle size ($d_1$) and a first average void fraction ($e_1$);

selecting a powder factor for each row of perimeter charges and a spacing distance between each outer row of central charges and the adjacent row of perimeter charges for producing a perimeter portion of the fragmented permeable mass having a second average particle size ($d_2$) different from the first average particle size ($d_1$) and a second average void fraction ($e_2$) different from the first average void fraction ($e_1$);

the second average particle size ($d_2$) and the second average void fraction ($e_2$) being related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.1 to 6.0; and detonating the central and perimeter explosive charges for explosively expanding the zone of unfragmented formation toward the void to form the fragmented permeable mass of formation particles in the retort.

13. The method according to claim 12 wherein the powder factor of the central explosive charges is less than the powder factor of the perimeter explosive charges.

14. The method according to claim 12 wherein the powder factor of the central explosive charges is greater than the powder factor of the perimeter explosive charges.

15. The method according to claim 12 wherein the spacing distance of the central explosive charges is greater than the spacing distance between each such outer row of central charges and the adjacent row of perimeter charges.

16. The method according to claim 12 wherein the explosive charges are columnar charges with each such charge column about perpendicular to the horizontally extending free face.

17. The method according to claim 12 wherein the second average particle size ($d_2$) and the second average void fraction ($e_2$) are related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.5 to 1.5.

18. The method according to claim 12 wherein the second average particle size ($d_2$) and the second average void fraction ($e_2$) are related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.5 to 1.0.

19. A method for forming an in situ oil shale retort in a retort site in a subterranean formation containing oil shale, the in situ retort containing a fragmented permeable mass of formation particles within top, bottom, and four generally vertically extending side boundaries of unfragmented formation, the method comprising the steps of:

excavating at least one generally horizontally extending void within the retort boundaries, while leaving a zone of unfragmented formation within the retort boundaries having a generally horizontally extending free face adjacent such a void;

placing a plurality of horizontally spaced apart columnar explosive charges in a selected pattern in the zone of unfragmented formation, each such columnar explosive charge being about perpendicular to the horizontally extending free face, the selected pattern of the explosive charges comprising:

an array of central explosive charges spaced apart from the side boundaries of the retort site, each of four outer rows of the array being about parallel to an adjacent retort side boundary; and a plurality of perimeter explosive charges surrounding the central charges, the perimeter charges being in four rows with each such row of perimeter charges adjacent one of the side boundaries, the spacing distance between such a row of perimeter charges and the adjacent outer row of central charges being about equal to the spacing distance between each other such row of perimeter charges and its respective adjacent outer row of central charges; and detonating the perimeter and central explosive charges for explosively expanding the zone of unfragmented formation toward the void for forming the fragmented permeable mass of formation particles in the retort, the fragmented mass comprising a center portion extending along the height of the retort formed by detonation of the central charges and a perimeter portion formed by detonation of the perimeter charges and surrounding the center portion, the central charges having a combination of spacing distance and powder factor selected for providing the center portion of the fragmented mass with a first average particle size ($d_1$) and first average void fraction ($e_1$), a combination of the powder factor of the perimeter charges and the spacing distance between each outer row of central charges and the adjacent row of perimeter charges being selected for providing the perimeter portion of the fragmented mass with a second particle size ($d_2$) different from the first average particle size ($d_1$) and a second void fraction ($e_2$) different from the first average void fraction ($e_1$), wherein the second particle size ($d_2$) and second void fraction ($e_2$) are related to the first particle size ($d_1$) and first void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.1 to 6.0.

20. The method according to claim 19 wherein the spacing distance of the central explosive charges is greater than the spacing distance between each such outer row of central charges and the adjacent row of perimeter charges.

21. The method according to claim 20 wherein the powder factor of the central explosive charges is less than the powder factor of the perimeter explosive charges.

22. The method according to claim 20 wherein the powder factor of the central explosive charges is greater than the powder factor of the perimeter explosive charges.

23. The method according to claim 19 wherein the second average particle size ($d_2$) and the second average void fraction ($e_2$) are related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is from about 0.5 to 1.5.

24. The method according to claim 19 comprising explosively expanding such a zone of unfragmented formation toward such a void by approximately simultaneously explosively expanding sequential portions of five horizontally spaced adjoining regions of the zone, a center region at about the center of the zone, and four outer regions collectively surrounding the center region, each of the five regions extending vertically from the generally horizontally extending free face adjacent the void, the five regions explosively expanded in sequential portions by the steps of:

detonating explosive charges for explosively expanding a first portion of each such region toward the void, wherein the horizontally extending free face of each such first portion is near the center of such a region; and thereafter detonating explosive charges for explosively expanding a second portion of each such region toward the void, wherein the horizontally extending free face of each such second portion is adjacent the respective free face of each such first portion and surrounds the free face of each such first portion.

25. The method according to claim 19 comprising explosively expanding such a zone of unfragmented formation toward such a void by approximately simultaneously explosively expanding sequential portions of five horizontally spaced adjoining regions of the zone, a center region at about the center of the zone, and four outer regions collectively surrounding the center region, each of the five regions extending vertically from the generally horizontally extending free face adjacent the void, the five regions explosively expanded in sequential portions by the steps of:

detonating central explosive charges for explosively expanding a first portion of each such region toward the void, wherein the horizontally extending free face of each such first portion is near the center of such a region; thereafter detonating central explosive charges for explosively expanding a second portion of each such region toward the void, wherein the horizontally extending free face of each such second portion is adjacent the respective free face of each such first portion and surrounds the free face of each such first portion; thereafter detonating the remainder of the central explosive charges and a plurality of the perimeter explosive charges for explosively expanding a third portion of each such region toward the void, wherein the horizontally extending free face of each such third portion is adjacent the free face of each such second portion and surrounds the free face of each such second portion; and thereafter detonating the remainder of the perimeter explosive charges for explosively expanding the remaining portion of each such region toward the void.

26. The method according to claim 19 wherein the powder factor of the central charges is about 1.5 pounds/ton and the spacing distance of the central charges is about 25 feet, and the powder factor of the perimeter charges is about 1.9 pounds/ton and the spacing distance between each outer row of central charges and the adjacent row of perimeter charges is about 20 feet.

27. The method according to claim 19 wherein the powder factor of the central charges is about 1.35 pounds/ton and the spacing distance of the central charges is about 30 feet, and the powder factor of the perimeter charge is about 1.9 pounds/ton and the spacing distance between each outer row of central charges and adjacent row of perimeter charges is about 20 feet.

28. The method according to claim 19 wherein the second average particle size ($d_2$) and the second average void fraction ($e_2$) are related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is from about 0.5 to 1.0.

29. A method for forming an in situ oil shale retort in a retort site in a subterranean formation containing oil shale, the in situ oil shale retort containing a fragmented permeable mass of formation particles within top, bottom, and four generally vertically extending side boundaries of unfragmented formation, the method comprising the steps of:

excavating an upper, an intermediate, and a lower void within the boundaries of the retort site, while leaving an upper zone of unfragmented formation extending between the upper and intermediate voids and a lower zone of unfragmented formation extending between the intermediate and lower voids, the upper zone of unfragmented formation having a generally horizontally extending upper free face defining the floor of the upper void and a generally horizontally extending lower free face defining the roof of the intermediate void, the lower zone of unfragmented formation having a generally horizontally extending upper free face defining the floor of the intermediate void and a generally horizontally extending lower free face defining the roof of the lower void;

placing a plurality of horizontally spaced apart upper explosive charges in the upper zone of unfragmented formation and a plurality of horizontally spaced apart lower explosive charges in the lower zone of unfragmented formation, the arrangement of upper explosive charges being about the same as the arrangement of the lower explosive charges, wherein each such arrangement of explosive charges comprises:

an array of central explosive charges spaced apart from the retort side boundaries, each of four outer rows of the array being about parallel to an adjacent retort side boundary; and a plurality of perimeter explosive charges surrounding the central charges, the perimeter charges being in four rows with each of the rows adjacent one of the side boundaries, the spacing distance between such a row of perimeter charges and the adjacent outer row of central charges being about equal to the spacing distance between each other such row of perimeter charges and its respective adjacent outer row of central charges, the combination of spacing distance and powder factor for the central explosive charges selected to produce a center portion of the fragmented permeable mass having a first average particle size ($d_1$) and a first average void fraction ($e_1$), the powder factor for each row of perimeter charges and the spacing distance between each outer row of central charges and the adjacent row of perimeter charges selected to produce a perimeter portion of the fragmented permeable mass having a second average particle size ($d_2$) different from the first average particle size ($d_1$) and a second average void fraction ($e_2$) different from the first average void fraction ($e_1$), the second particle size ($d_2$) and void fraction ($e_2$) being related to the first particle size ($d_1$) and void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.1 to 6.0; and detonating the central and perimeter explosive charges in both the upper and lower zones of unfragmented formation for explosively expanding the zones toward the voids for forming the fragmented permeable mass of formation particles in the retort.

30. The method according to claim 29 wherein both the upper and lower zones of unfragmented formation are explosively expanded in a single round time delay sequence of detonations in five horizontally spaced adjoining regions, a center region at about the center of the zone and four outer regions collectively surrounding the center region, each of the five regions extending vertically between the upper and lower free faces of the zone of unfragmented formation, the five regions of each of the zones of unfragmented formation explosively expanded in sequential portions by the steps of:

detonating explosive charges for explosively expanding a first portion of each such region toward the voids, wherein the horizontally extending upper and lower free faces of each such first portion is near the center of such a region; and thereafter detonating explosive charges for explosively expanding a second portion of each such region toward the void, wherein the horizontally extending upper and lower free faces of each such second portion are adjacent the respective upper and lower free faces of each such first portion and surround the free faces of each such first portion.

31. The method according to claim 29 wherein the powder factor of the central charges is about 1.5 pounds/ton and the spacing distance of the central charges is about 25 feet, and the powder factor of the outer charges is about 1.9 pounds/ton and the spacing distance between each outer row of central charges and the adjacent row of perimeter charges is about 20 feet.

32. The method according to claim 29 wherein the powder factor of the central charges is about 1.35 pounds/ton and the spacing distance of the central charges is about 30 feet, and the powder factor of the perimeter charge is about 1.9 pounds/ton and the spacing distance between each outer row of central charges and adjacent row of perimeter charges is about 20 feet.

33. The method according to claim 29 wherein the powder factor of the central explosive charges is less than the powder factor of the perimeter explosive charges.

34. The method according to claim 29 wherein the powder factor of the central explosive charges is greater than the powder factor of the perimeter explosive charges.

35. The method according to claim 29 wherein the explosive charges are columnar charges with each such charge column about perpendicular to the horizontally extending free face.

36. The method according to claim 29 wherein the second average particle size ($d_2$) and the second average void fraction ($e_2$) is related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is from about 0.5 to about 1.5.

37. The method according to claim 29 wherein the second average particle size ($d_2$) and the second average void fraction ($e_2$) is related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is from about 0.5 to about 1.0.

38. A method for forming an in situ oil shale retort in a retort site in a subterranean formation containing oil shale, the in situ oil shale retort containing a fragmented permeable mass of formation particles within top, bottom, and four generally vertically extending side boundaries of unfragmented formation, the method comprising the steps of:

excavating an upper, an intermediate, and a lower void within the boundaries of the retort site, while leaving an upper zone of unfragmented formation extending between the upper and intermediate voids and a lower zone of unfragmented formation extending between the intermediate and lower voids, the upper zone of unfragmented formation having a generally horizontally extending upper free face defining the floor of the upper void and a generally horizontally extending lower free face defining the roof of the intermediate void, the lower zone of unfragmented formation having a generally horizontally extending upper free face defining the floor of the intermediate void and a generally horizontally extending lower free face defining the roof of the lower void;

placing a plurality of horizontally spaced apart upper explosive charges in the upper zone of unfragmented formation and a plurality of horizontally spaced apart lower explosive charges in the lower zone of unfragmented formation, the arrangement of upper explosive charges being about the same as the arrangement of the lower explosive charges, wherein each such arrangement of explosive charges comprises:

an array of central explosive charges spaced apart from the retort side boundaries, each of four outer rows of the array being about parallel to an adjacent retort side boundary; and a plurality of perimeter explosive charges surrounding the central charges, the perimeter charges being in four rows with each of the rows adjacent one of the side boundaries, the spacing distance between such a row of perimeter charges and the adjacent outer row of central charges being about equal to the spacing distance between each other such row of perimeter charges and its respective adjacent outer row of central charges, the combination of spacing distance and powder factor for the central explosive charges being selected to produce a center portion of the fragmented permeable mass having a first average particle size ($d_1$) and a first average void fraction ($e_1$), the powder factor for each row of perimeter charges and the spacing distance between each outer row of central charges and the adjacent row of perimeter charges selected to produce a perimeter portion of the fragmented permeable mass having a second average particle size ($d_2$) different from the first average particle size ($d_1$) and a second average void fraction ($e_2$) different from the first average void fraction ($e_1$), the second particle size ($d_2$) and void fraction ($e_2$) being related to the first particle size ($d_1$) and void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.1 to 6.0; and detonating the central and perimeter explosive charges in the upper zone of unfragmented formation for explosively expanding the upper zone upwardly toward the upper void and downwardly toward the intermediate void and detonating the central and outer explosive charges in the lower zone of unfragmented formation for explosively expanding the lower zone upwardly toward the intermediate void and downwardly toward the lower void, both the upper and lower zones explosively expanded in five horizontally spaced adjoining regions, a center region at about the center of the zone and four outer regions surrounding the center region, each of the five regions extending vertically between the upper and lower free faces of the zone of unfragmented formation, the five regions of each of the zones of unfragmented formation explosively expanded in sequential portions by the steps of:

detonating central explosive charges for explosively expanding a first portion of each such region toward the void, wherein the horizontally extending upper and lower free faces of each such first portion is near the center of such a region; thereafter detonating central explosive charges for explosively expanding a second portion of each such region toward the void, wherein the horizontally extending upper and lower free faces of each such second portion are adjacent the respective upper and lower free faces of each such first portion and surround the free faces of each such first portion; thereafter detonating the remainder of the central explosive charges and a plurality of the perimeter explosive charges for explosively expanding a third portion of each such region toward the void, wherein the horizontally extending upper and lower free faces of each such third portion are adjacent the respective upper and lower free faces of each such second portion and surround the free faces of each such second portion; and thereafter detonating the remainder of the perimeter explosive charges for explosively expanding the remaining portion of each such region toward the voids.

39. The method according to claim 38 wherein the powder factor of the central charges is about 1.5 pounds/ton and the spacing distance of the central charges is about 25 feet, and the powder factor of the perimeter charges is about 1.9 pounds/ton and the spacing distance between each outer row of central charges and the adjacent row of perimeter charges is about 20 feet.

40. The method according to claim 38 wherein the powder factor of the central charges is about 1.35 pounds/ton and the spacing distance of the central charges is about 30 feet, and the powder factor of the perimeter charge is about 1.9 pounds/ton and the spacing distance between each outer row of central charges and adjacent row of perimeter charges is about 20 feet.

41. The method according to claim 38 wherein the powder factor of the central explosive charges is less than the powder factor of the perimeter explosive charges.

42. The method according to claim 38 wherein the powder factor of the central explosive charges is greater than the powder factor of the perimeter explosive charges.

43. The method according to claim 38 wherein the explosive charges are columnar charges with each such charge column about perpendicular to the horizontally extending free face.

44. The method according to claim 38 wherein the second average particle size ($d_2$) and the second average void fraction ($e_2$) is related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is from about 0.5 to about 1.5.

45. The method according to claim 38 wherein the second average particle size ($d_2$) and the second average void fraction ($e_2$) is related to the first average particle size ($d_1$) and the first average void fraction ($e_1$) so that the relation $$\left(\frac{d_2}{d_1}\right)^2 \times \left(\frac{1-e_1}{1-e_2}\right)^2 \times \left(\frac{e_2}{e_1}\right)^3$$

is from about 0.5 to 1.0.

46. A method for forming an in situ oil shale retort in a retort site in a subterranean formation containing oil shale, the in situ retort containing a fragmented permeable mass of formation particles within top, bottom, and four generally vertically extending side boundaries of unfragmented formation, the method comprising the steps of:

excavating at least one void in the subterranean formation within the boundaries of the retort site, while leaving at least one zone of unfragmented formation within the boundaries of the retort site having a generally horizontally extending free face adjacent the void;

placing a plurality of horizontally spaced apart explosive charges in a selected pattern in such a zone of unfragmented formation, the selected pattern comprising:

a plurality of perimeter explosive charges in a band of four rows with each row adjacent a side boundary, the charges in each perimeter row having a first, relatively smaller spacing distance; and a plurality of central explosive charges within the band of perimeter explosive charges and having a second relatively larger spacing distance, the spacing distance between the outermost central charges and each row of perimeter charges being intermediate between the first and second spacing distances, the powder factor of the central charges being less than the powder factor of the perimeter charges; and detonating the central and perimeter explosive charges for explosively expanding the zone of unfragmented formation toward the void to form the fragmented permeable mass of formation particles in the retort.

47. The method according to claim 46 wherein the powder factor of the central charges is about 1.5 pounds/ton, the spacing distance of the central charges is about 25 feet, the powder factor of the outer perimeter charges is about 1.9 pounds/ton and the spacing distance between the outermost central charges and each adjacent row of perimeter charges is about 20 feet.

48. The method according to claim 47 wherein the spacing distance of the perimeter charges is about 15 feet.

49. The method according to claim 46 wherein the powder factor of the central charges is about 1.35 pounds/ton, the spacing distance of the central charges is about 30 feet, the powder factor of the perimeter charges is about 1.9 pounds/ton, and the spacing distance between each outer row of central charges and adjacent row of perimeter charges is about 20 feet.

50. The method according to claim 49 wherein the spacing distance of the perimeter charges is about 15 feet.

51. The method according to claim 49 wherein the second average particle size ($d_2$) is related to the first average particle size ($d_1$) so that the relation $$\left(\frac{d_2}{d_1}\right)^2 \times \left(\frac{1-e_1}{1-e_2}\right)^2 \times \left(\frac{e_2}{e_1}\right)^3$$

is from about 0.5 to about 1.0.

52. A method for forming an in situ oil shale retort in a retort site in a subterranean formation containing oil shale, the in situ retort containing a fragmented permeable mass of formation particles within top, bottom, and four generally vertically extending side boundaries of unfragmented formation, the method comprising the steps of:

excavating at least one void in the subterranean formation within the boundaries of the retort site, while leaving at least one zone of unfragmented formation within the boundaries of the retort site having a generally horizontally extending free face adjacent the void;

placing a plurality of horizontally spaced apart explosive charges in a selected pattern in such a zone of unfragmented formation, the selected pattern comprising:

an array of central explosive charges spaced apart from the side boundaries of the retort site, each of four outer rows of the array being about parallel to an adjacent retort side boundary; and a plurality of perimeter explosive charges surrounding the central charges, the perimeter charges being in four rows with each of the rows adjacent one of the side boundaries, the spacing distance between each such row of perimeter charges and the adjacent outer row of central charges being about equal to the spacing distance between each other such row of perimeter charges and its respective adjacent outer row of central charges;

selecting a combination of spacing distance and powder factor for the central explosive charges for producing a center portion of the fragmented permeable mass having a first average particle size ($d_1$) and a first average void fraction ($e_1$);

selecting a powder factor for each row of perimeter charges and a spacing distance between each outer row of central charges and the adjacent row of perimeter charges for producing a perimeter portion of the fragmented permeable mass having a second average particle size ($d_2$) different from the first average particle size ($d_1$) and a second average void fraction ($e_2$) the same as the first average void fraction ($e_1$);

the second average particle size ($d_2$) being related to the first average particle size ($d_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.1 to 6.0; and detonating the central and perimeter explosive charges for explosively expanding the zone of unfragmented formation toward the void to form the fragmented permeable mass of formation particles in the retort.

53. The method according to claim 52 wherein the powder factor of the central explosive charges is less than the powder factor of the perimeter explosive charges.

54. The method according to claim 52 wherein the powder factor of the central explosive charges is greater than the powder factor of the perimeter explosive charges.

55. The method according to claim 52 wherein the spacing distance of the central explosive charges is greater than the spacing distance between each such outer row of central charges and the adjacent row of perimeter charges.

56. The method according to claim 52 wherein the explosive charges are columnar charges with each such charge column about perpendicular to the horizontally extending free face.

57. The method according to claim 52 wherein the second average particle size ($d_2$) is related to the first average particle size ($d_1$) so that the relation $$\left(\frac{d_2}{d_1}\right)^2 \times \left(\frac{1-e_1}{1-e_2}\right)^2 \times \left(\frac{e_2}{e_1}\right)^3$$

is in the range of from about 0.5 to 1.5.

* * * * *